US005228155A

United States Patent [19]

Shultz et al.

[11] Patent Number: 5,228,155

[45] Date of Patent: Jul. 20, 1993

[54] BED APPARATUS HAVING MULTIDIRECTIONAL MOVEMENT

[76] Inventors: Larry D. Shultz, 730 Yale St., Santa Paula, Calif. 93060; Arnold Stillman, 5756 Montessa Dr., Camarillo, Calif. 93010

[21] Appl. No.: 945,398

[22] Filed: Sep. 16, 1992

[51] Int. Cl.[5] ..... A47D 9/02

[52] U.S. Cl. ..... 5/109; 128/33

[58] Field of Search ..... 5/101, 108, 109; 128/24 R, 33, 45, 46

[56] References Cited

U.S. PATENT DOCUMENTS

| | | | |
|---|---|---|---|
| 2,707,465 | 5/1955 | Nemeth | 128/33 |
| 2,936,464 | 5/1960 | Miller et al. | 5/109 |
| 2,972,152 | 2/1961 | Vincent | 5/109 |
| 3,056,145 | 10/1962 | McKinley et al. | 5/109 |
| 4,061,137 | 12/1977 | Sandt | 128/33 |
| 5,113,851 | 5/1992 | Gamba | 128/45 X |

*Primary Examiner*—Michael F. Trettel
*Attorney, Agent, or Firm*—Jack C. Munro

[57] ABSTRACT

A multi-tilting movement platform that periodically and gradually tilts a platform supporting a person's body, that platform tilting periodically and gradually, side to side and head to foot; the side tilt following the head tilt and preceding the foot tilt, and so on. The apparatus enables a user to experience sensations which have been reported as relaxing, stress relieving and beneficial. The apparatus comprises a base, a platform for holding a human body thereon, an elongated teeter-totter board pivotally mounted upon the base, a drive shaft upon which is mounted a tilted plate. Low frictional rollers support the platform on the tilted plate with the platform also being pivotally supported on a first pivot axis on the teeter-totter board with the teeter-totter board being mounted on a second pivot axis on the base. The first pivot axis is oriented perpendicular to the second pivot axis. The function is that the platform does not turn as the drive shaft turns, but rather tilts multidirectionally (side to side and head to foot) as the tilted plate turns on the drive shaft contacting the rollers on the platform.

4 Claims, 3 Drawing Sheets

BED APPARATUS HAVING MULTIDIRECTIONAL MOVEMENT

BACKGROUND OF THE INVENTION

1. Field of the Invention

This invention relates generally to an apparatus for supporting and periodically and gradually tilting a human body to provide multidirectional movement to human beings. The apparatus enables a user to experience sensations which have been reported to be stress-relieving, relaxing and generally beneficial.

2. Description of Prior Art

Existing prior patents which may be pertinent to this invention are as follows:

| | | |
|---|---|---|
| Nisle | 1,420,134 | June 20, 1922 |
| Marchese | 1,909,204 | May 16, 1933 |
| Kost | 2,595,272 | May 6, 1952 |
| Rubin | 2,808,828 | October 8, 1957 |
| Fujimoto | 3,678,924 | July 25, 1972 |
| Jameson | 3,916,882 | November 4, 1975 |
| Graham | 4,256,095 | March 10, 1981 |
| Stillman | 5,044,377 | September 3, 1991 |

None of these patents offer the new and novel features of the present invention. The Fujimoto device has a pressing plate with projections. However, this plate does not rotate, nor does it or could it drive any human-holding cradle or bed structure. Jameson teaches a bed capable of rhythmic tilting, while Rubin shows a bed with a ball joint for rocking it in three directions. The Marchese cradle is rocked by a mechanical drive with linkage. Nisle shows a mechanical drive attached to a ball joint for multidirectional movement. Graham discloses an electromechanical therapeutic apparatus for rotating a human subject about a horizontal axis and through a continuum of horizontal planes, while subjecting the human subject to a low energy electrical field. Kost has a chair or crib apparatus mounted on a ball joint and rocked with a moveable crank arm. The Stillman apparatus provides multidirectional tilting but it does so by rotating the human subject on a platform which is slant-mounted to a drive shaft. However, none of these devices are like the apparatus of subject invention.

SUMMARY OF THE INVENTION

The principal object of the present invention is to provide a human-holding cradle or bed apparatus arranged to provide multidirectional sequential tilting to a human. It is reported that users experience relief from stress and profound relaxation.

A still further object is to provide a multidirectional movement apparatus having an easily separable supporting and driving structure for a bed that can be quickly and easily removed and replaced for maintenance reasons.

The present invention comprises a multi-axis movement bed for supporting and moving a human body so as to provide multidirectional tilting thereto. The apparatus includes a base, a platform for holding a human body thereon, an elongated board having pivot pins on each side midway thereof for pivotally mounting such upon the base, a support stub at each of the respective ends of the board, an open block bearing on each respective stub for pivotally supporting pivot rods extending from the platform, a vertical drive shaft, a drive motor with speed reduction gearing for effecting rotation of the drive shaft, a tilted plate affixed to the drive shaft, and rollers between the under surface of the platform and the tilted plate for effecting multidirectional tilting of the platform as the drive shaft rotates. This arrangement permits quick and easy removal of the platform from the supporting and driving structure. The platform may have a plurality of substantially vertical spindles around the perimeter thereof and guard rails mounted on the upper ends of the spindles for safety and protection of a human located on the platform thereby changing the platform into a cradle.

DETAILED DESCRIPTION OF THE SHOWN EMBODIMENT

Figure 2:
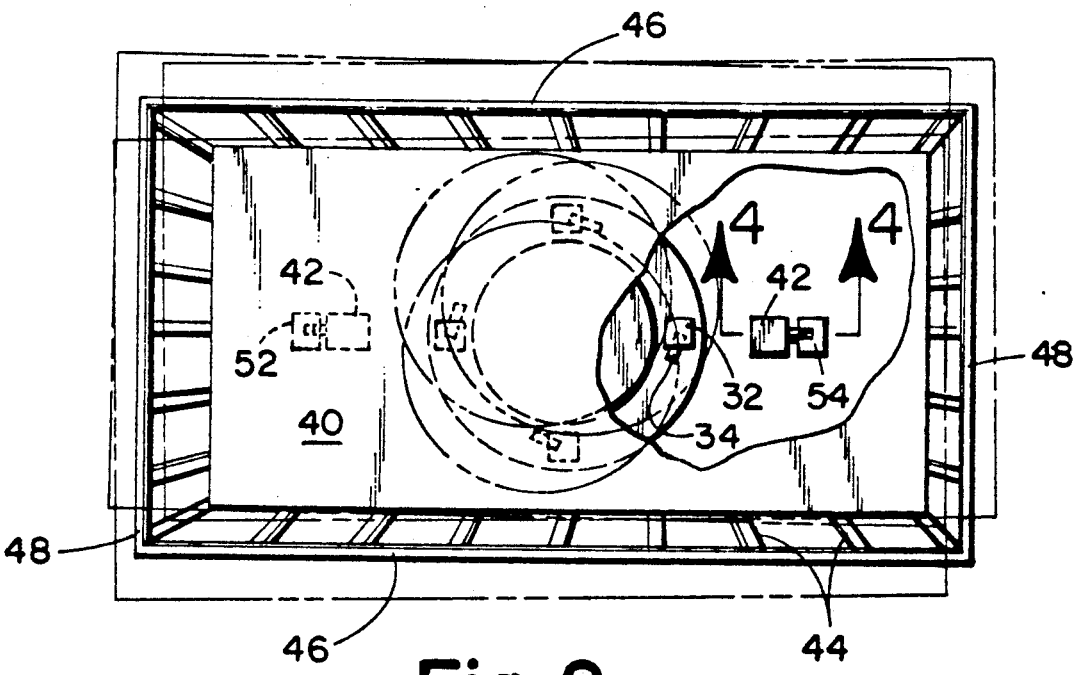
FIG. 2 is a top plan view of the apparatus of this invention with part of the platform broken away for illustrative purposes.
Figure 1:
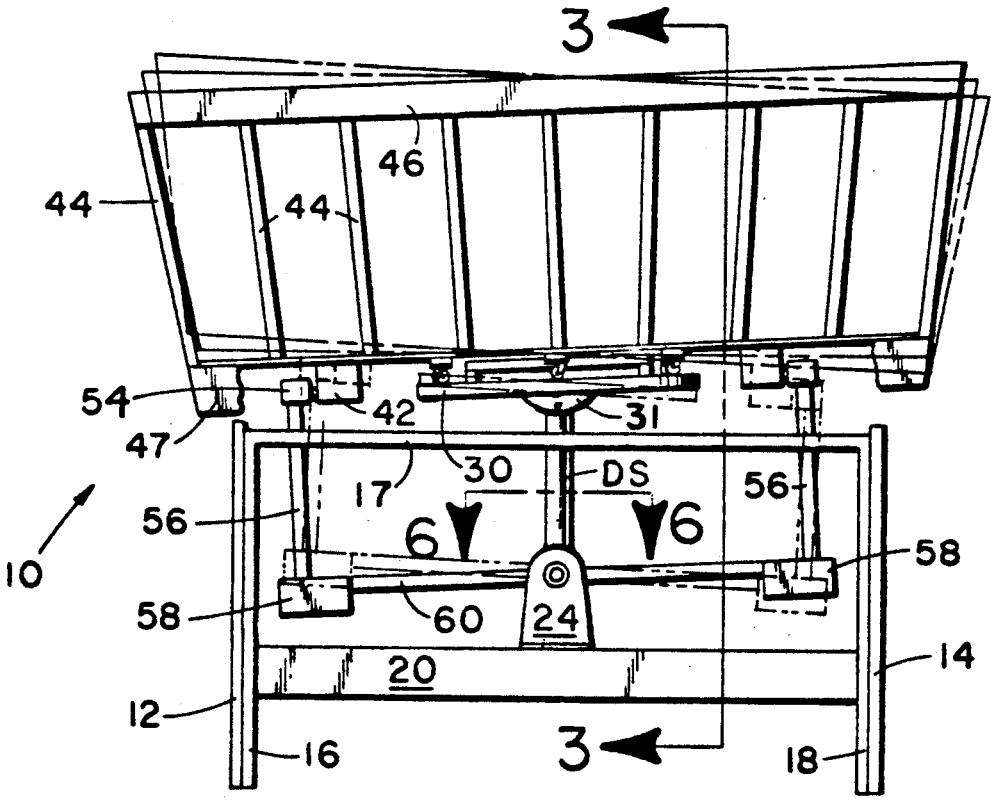
FIG. 1 is a side elevational view of the present invention depicting motion.
Figure 4:
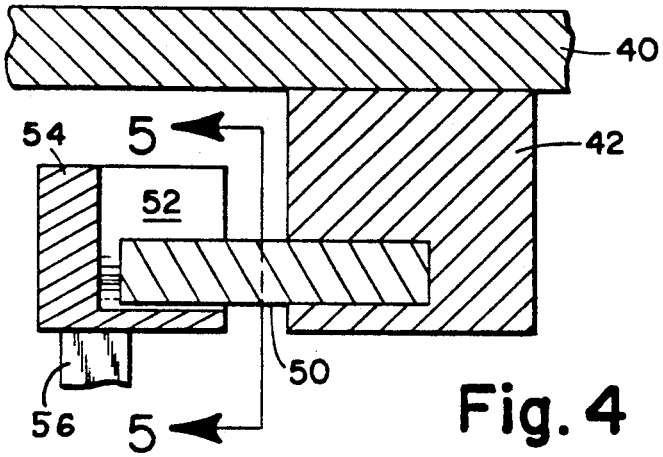
FIG. 4 is a cross-sectional view taken along line 4—4 of FIG. 2.
Figure 5:
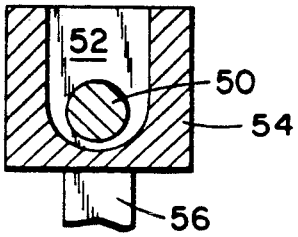
FIG. 5 is a cross-sectional view taken along line 5—5 of FIG. 4.
Figure 6:
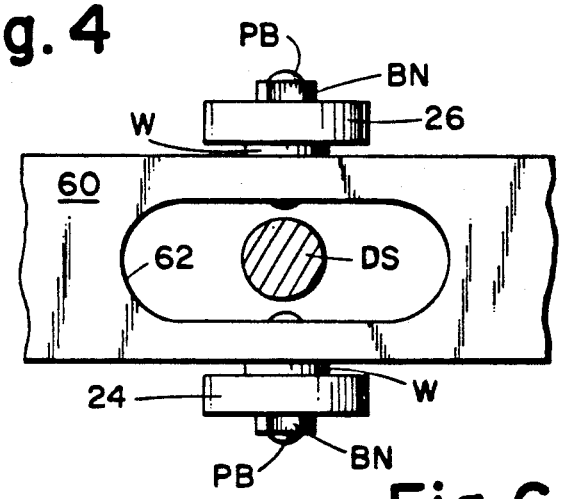
FIG. 6 is a top plan view, partly in cross-section, taken along line 6—6 of FIG. 1.
Figure 3:
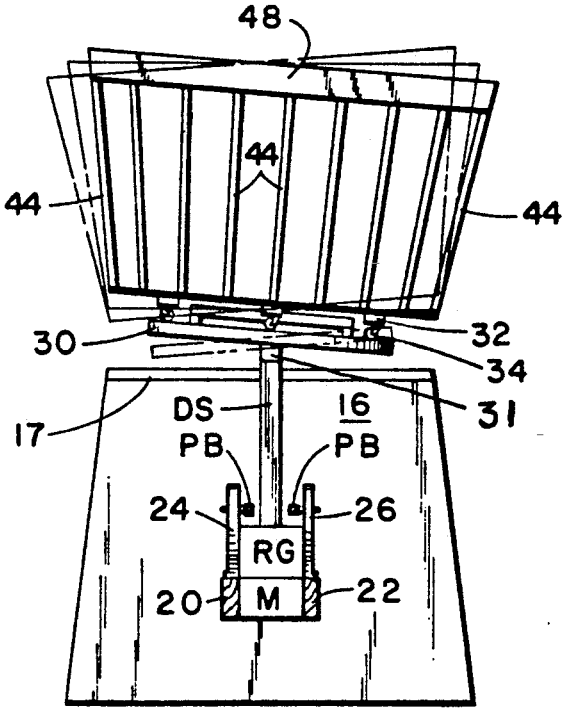
FIG. 3 is an end elevational view, partly in cross-section, taken along line 3—3 of FIG. 1.

Looking at FIG. 1 of the drawings, there is shown a multidirectional tilting human cradle apparatus 10 of this present invention. The base comprises ends 12 and 14 with inner strengthening portions 16 and 18 and top 17. Suitable openings are provided in top 17 for the support and drive elements described below. Bar 20 and 22 are mounted horizontally between ends 12 and 14. Bars 20 and 22 respectively support brackets 24 and 26 thereon with drive motor M and reduction gearing RG there between. Motor M preferably is electric with reduction gearing RG being of any common type. The primary requirement is to rotate drive shaft DS at a relatively slow constant rate.

Affixed to the upper end of the drive shaft DS is a circular drive plate 30. A hub 31 is used to attach plate 30 to shaft DS at a fixed tilted angle with respect to shaft DS it is plate 30 which effects the desired movement of the cradle which rests thereupon. This is done through roller mounts 32 and the rollers 34 held thereby. In FIGS. 1-6, the rollers mount 32 are fixed to platform 40 of the cradle.

The cradle comprises a platform 40, a plurality of substantially vertical spindles 44, and upper guard rails 46 and 48. It is to be understood that only platform 40 need be used as a support for a mattress when the apparatus of this invention is used for adults. An important feature of the present invention is the ease and simplicity of removal and replacement of the cradle form the drive and support structure. This allows good and thorough cleaning and disinfecting of the cradle prior to reuse or replacement of the cradle. This, of course, also permits different sizes, types and styles of cradles (as well as beds) to be used interchangeably.

The support structure is simple yet entirely functional, easy to use and maintain. The support structure comprises pivot rods 50, one each, which extends outwardly from a pivot rod block 42 which are affixed to the underside platform 40. These pivot rods 50 are located at the transverse mid-line of the cradle lengthwise (see FIG. 2). Pivot rods 50 in turn rest in the open channels 52 of the bearing blocks 54. A block 54 is affixed to the upper end of a stub 56. The lower end of both the stubs 56 are each mounted in a support block 58 . There is a block 58 located at each end of a teeter-totter board 60.

The teeter-totter board 60 has pivot bolts P midway thereof. Washers W and bolt nuts BN secure pivot bolts PB to the support brackets 24 and 26. The elongated aperture 62 in the center of teeter-totter board 60 permit the pivot bolts PB to be installed and in addition provides an opening for the vertical drive shaft DS. It should be noted that the connecting center axis of pivot bolts PB is at right angles to the longitudinal center axis of pivot rods 50 thus supporting the cradle for multidimensional movement produced by the tilted plate 30 as it rotates.

Figure 7:
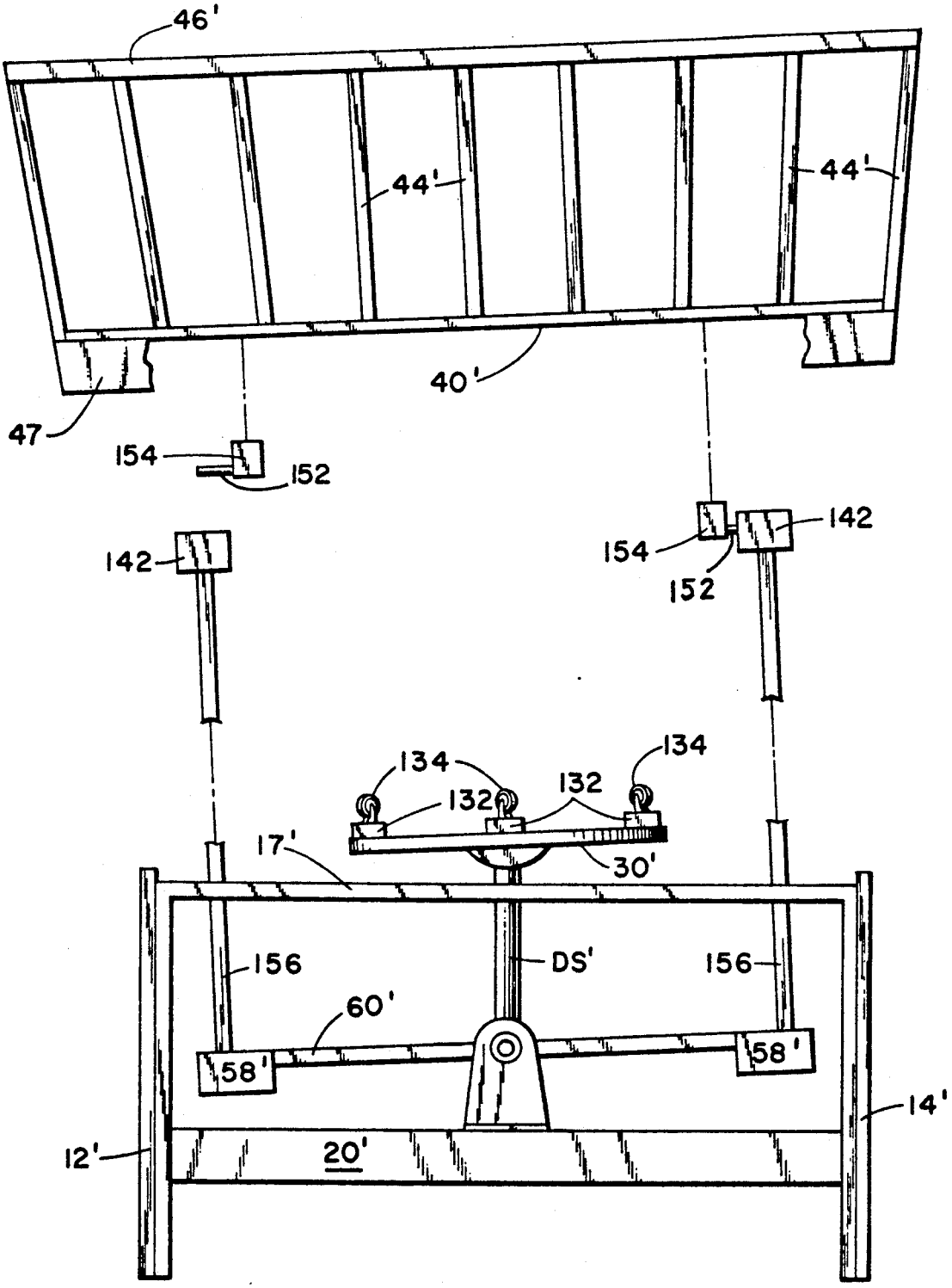
FIG. 7 is an exploded side elevational view of a modified embodiment of the present invention.

FIG. 7 depicts in exploded form a modified embodiment of the present invention. In this modified embodiment elements identical to those of the first embodiment have the same reference numerals with a prime mark added. The low friction drive rollers 134 are mounted by roller holders 132 directly on the angled drive plate 30' instead of on the underside of the platform 40. Furthermore, pivot rods 156 are mounted by blocks 142 on the support stubs 58'. Thus, except for open bearing blocks 154, nothing is mounted on the underside of cradle platform 40. Pivot shafts 152 (one each mounted on a bearing block 154) are to pivotally connect with a block 142 (only one shaft 152 per block 142). With this modification, the cradles are even more interchangeable than with the structure shown in FIGS. 1 to 6.

As can be readily envisioned, the present invention offers a user thereof a very simple, easy device for achieving relaxation through calming motion, and simply by changing from a cradle to a bed, adults as well as infants can be accommodated. The apparatus of this invention will be an important addition to the present equipment of health and fitness clubs, elderly retirement homes, youth centers, and the like.

What is claimed is:

1. A bed apparatus comprising:

a base adapted to be located on a supporting surface;

a drive shaft mounted on said base, said drive shaft having a longitudinal center axis located in a vertical direction (aligned with the direction of gravity), a motor connected to said drive shaft, said motor to cause rotation of said drive shaft;

a teeter-totter board pivotally mounted on said base on a first pivot axis, said teeter-totter board terminating in opposing ends with a pivot rod fixedly mounted at each said opposing end, said pivot rods being located parallel and spaced apart, said pivot rods having upper free ends;

a bed platform pivotally mounted on said upper free ends forming a second pivot axis, said second pivot axis being located substantially perpendicular to said first pivot axis but is spaced therefrom;

a plate defining a planar upper surface, said plate being attached to said drive shaft and is rotatable thereby, said planar upper surface intersecting said longitudinal center axis at an angle tilted from horizontal; and low frictional rolling means mounted on said plate, said plate resting on said low frictional rolling means, whereby as said drive shaft rotates said platform is caused to move in a tilting sequential manner and multidirectionally, said tilting sequential manner being defined as a side tilt following a head tilt and then a foot tilt and then repeating the movement, with this movement being permitted by pivoting simultaneously on said first pivot axis and said second pivot axis.

2. The bed apparatus as defined in claim 1 wherein: said pivot rods being of the same length.

3. The bed apparatus as defined in claim 2 wherein: said first pivot axis intersecting said longitudinal center axis.

4. The bed apparatus as defined in claim 3 wherein: said first pivot axis being located at the longitudinal mid point of said teeter-totter board.

* * * * *